US005078538A

United States Patent [19]

Montalbano

[11] Patent Number: 5,078,538

[45] Date of Patent: Jan. 7, 1992

[54] BASE FOR ROADWAY MARKER AND METHOD FOR MAKING SAME

[75] Inventor: Anthony J. Montalbano, Cook County, Ill.

[73] Assignee: Stimsonite Corporation, Niles, Ill.

[21] Appl. No.: 491,104

[22] Filed: Mar. 8, 1990

Related U.S. Application Data

[63] Continuation-in-part of Ser. No. 367,524, Jun. 16, 1989, abandoned.

[51] Int. Cl.[5] ..... F01F 11/00

[52] U.S. Cl. ..... 404/9; 404/12; 404/14; 404/15

[58] Field of Search ..... 404/9, 12, 14, 15, 35

[56] References Cited

U.S. PATENT DOCUMENTS

| | | | |
|---|---|---|---|
| 1,903,214 | 3/1933 | Goransson | 404/9 |
| 1,920,582 | 8/1933 | Myers | 404/15 |
| 1,952,471 | 3/1934 | Stern et al. | 404/15 |
| 2,180,105 | 11/1939 | Farrell | 404/9 |
| 3,427,933 | 2/1969 | Taylor-Myers | 404/9 |
| 3,798,743 | 3/1974 | Griswold | 404/15 X |
| 3,809,487 | 5/1974 | Flanagan | 404/15 |
| 3,971,623 | 7/1976 | Hedgewick et al. | 404/12 X |
| 4,428,320 | 1/1984 | Oplt et al. | 404/14 X |
| 4,498,733 | 2/1985 | Flanagan | 404/14 X |
| 4,710,053 | 12/1987 | Kulp et al. | 404/9 |

FOREIGN PATENT DOCUMENTS

| | | | |
|---|---|---|---|
| 888609 | 9/1953 | Fed. Rep. of Germany | 404/15 |
| 1252512 | 12/1960 | France | 404/15 |
| 423141 | 7/1947 | Italy | 404/15 |
| 624959 | 9/1961 | Italy | 404/12 |

*Primary Examiner*—William P. Neuder

*Attorney, Agent, or Firm*—Jones, Day, Reavis & Pogue

[57] ABSTRACT

A pavement marker base is provided having a generally planar bottom support surface with an array of downwardly facing open chambers molded therein. Deformations are formed on the bottom surfaces of at least some of the walls dividing the chambers, and also preferably in the peripheral support surface of the marker base to provide additional downwardly facing surface area to mate with an adhesive material used to adhere the marker base to a roadway surface. These deformations may be characterized by a variety of surface shapes, such as arcs, rectangular notches, and dovetails. In the preferred embodiment, chamber walls include outwardly directed lips to engage the adhesive material. In another embodiment of the invention, a wire mesh covers at least some of the bottom surface of the marker base, and is imbedded within the bottom surface of the chamber walls and peripheral support surface. The mesh engages with the adhesive to provide a strong means of anchorage.

10 Claims, 4 Drawing Sheets

BASE FOR ROADWAY MARKER AND METHOD FOR MAKING SAME

This is a continuation in part of co-pending application Ser. No. 07/367,524 filed on June 16, 1989, now abandoned.

BACKGROUND OF THE INVENTION

The present invention is directed to an improved roadway marker base structure, and specifically, to the type of marker base having a downwardly-facing, generally waffle-shaped structure, with downwardly-facing open chambers, which is fixed to a pavement surface by adhesive means.

Historically, many types of roadway markers were used, such as a daytime ceramic marker employed by the State of California in the early 1960's. This particular marker consisted of a solid piece of ceramic material with a high gloss, domed top and bumped protrusions on the bottom. The bottom configuration could not deviate more than 0.05 inches from a flat surface. These bumped protrusions enhanced the bottom surface area of the marker for cooperation with an associated adhesive material when the marker base was affixed to a roadway surface. However, a nighttime marker requires reflective portions which may be more easily added to the top of a marker base made from plastic.

From a manufacturing perspective, not only would it be prohibitively expensive to make a solid plastic marker base to the thickness of the prior art ceramic model, but also such a marker would suffer from shrinkage during the molding process. Thus, any design for a plastic marker base must maintain reasonably small wall thicknesses. Hence, the prior art evolved to use of a thermoplastic shell molded with plastic ribs in a waffle-like arrangement as found in U.S. Pat. No. D-267,933 issued Feb. 15, 1983. The design of such a marker includes chamber walls which are downwardly tapered to a narrow dimension at the roadway surface to provide a draft for ready removal of the marker from the mold. At the same time, the small bottom surface area of these chamber walls does not permit inclusion of large bumped protrusions during the molding process. Therefore, the downward facing surfaces of the chamber walls are coplanar and rest on the roadway surface. These markers are installed by depositing a suitable adhesive, such as bitumin or epoxy, on either the roadway surface or the underside of the marker base so that the adhesive is sandwiched between the roadway surface and the marker base. Downward pressure is then applied to seat the marker base in the adhesive.

If, in the installation as above-described, the marker is fully seated on the pavement with sufficient downward pressure, it has been found that substantially all of the adhesive is squeezed upward into the chambers of the base, thus leaving only a thin film of adhesive between the thin, downwardly facing support surfaces and the roadway surface. This "cookie cutter" effect provides very little adhesive between the road surface and the opposing marker base surfaces to anchor the marker base to the pavement. This sometimes has resulted in markers of this character being too easily knocked off of or accidentally removed from the road.

Another disadvantage of the prior art roadway marker stems from the choice of adhesive material. Epoxy has been commonly used, and it works very well on concrete surfaces; however, it takes a considerable amount of time (15–20 minutes) to set up, thereby necessitating closing off sections of the roadway with cones for extended periods of time. This is particularly inconvenient for temporary marker applications where quick installation is desirable. Moreover, both temporary and permanent markers are frequently used on asphalt surfaces. But, when epoxy is used on asphalt roadways, there may be long-term effects with a crack forming around the epoxy in the asphalt, generally referred to as "reflective cracking." Under those conditions, a marker, the epoxy, and part of the asphalt itself ultimately may be knocked out.

It has been found that bituminous adhesives are more suitable for placement on asphalt, concrete, and chipped-seal-type road surfaces. They are asphaltic materials with a homogenously mixed mineral filler as is well known to those skilled in the art. They eliminate the reflective cracking which appears when epoxy is used on the asphaltic surface. In addition, bitumin sets up normally in 30 seconds to a minute, and, therefore, the labor required for installation of markers with adhesives of that character is significantly reduced.

Bituminous adhesive also is more often used with "temporary" marker installations, such as in construction zones, where epoxy cannot be used because one would not be easily able to remove the epoxy-installed markers from the roadway without tearing up the roadway, whereas the bituminous adhesive can be scraped off. Therefore bituminous adhesively affixed markers are suitable for both permanent and temporary installations. However, because the bituminous material is somewhat flexible (which gives it the ability to be removed from the road), difficulties have arisen with respect to mounting open-shell-type markers of the prior art, such as that found in U.S. Pat. No. D-267,933. Because of such flexibility, the adhesive connection between the shell and the bottom suffers from the problem previously described.

The present invention overcomes the adhesion problem by providing anchoring surfaces on the bottom walls of the marker, which facilitate both a mechanical and adhesive interlock when the marker is installed. The bituminous material is allowed to flow into the chambers, and the marker can be easily installed by simply stepping down on it after the bitumen is applied to the roadway surface in a heated, relatively free-flowing state. The bituminous material can then flow in and around the anchoring surfaces and provide very strong and tough bonding, both for temporary and permanent marker installation.

SUMMARY OF THE INVENTION

It is an important object of the present invention to provide an improved base structure for the "waffle-type" pavement marker base member, having downwardly-facing open chambers with superior holding ability to prevent dislodgment of the marker from the pavement.

Another object of the invention is to provide an improved marker base member structure of the type set forth, including increased downwardly-facing surface area to adhere to a roadway adhesive.

Yet another object of the invention is to provide an improved marker base member structure of the type set forth, including increased downwardly-facing deformations to contain, preserve, and assure a predetermined, controllable amount of adhesive between the marker base and roadway surface when the marker base is fully depressed onto the roadway surface.

Another object of the invention is to provide a marker base structure of the type described, including horizontally protruding projections to interlock with roadway adhesive to anchor the marker in the adhesive.

In the present invention, the chamber walls are deformed upwardly and outwardly to provide therein downwardly-facing deformed surfaces to contain a predetermined, controllable amount of adhesive between a broadened, downwardly-facing surface and the pavement. The surface configuration of this broadened deformation can adopt a variety of shapes, such as arcs, rectangular niches, and dovetails. Moreover, the outward deformation of the wall provides a lip to interlock with the adhesive to firmly anchor the marker in place. In an alternate embodiment, a piece of wire mesh is affixed to the bottom of substantially undeformed chamber walls, and the mesh interlocks with the adhesive.

Further features of the invention pertain to the particular arrangement of the parts of the base structure whereby the above objects and additional features thereof are attained.

BRIEF DESCRIPTION OF THE DRAWINGS

FIG. 11 is a partial perspective view of a marker base incorporating another alternate embodiment of the present invention;

DESCRIPTION OF THE PREFERRED EMBODIMENTS

Figure 1:
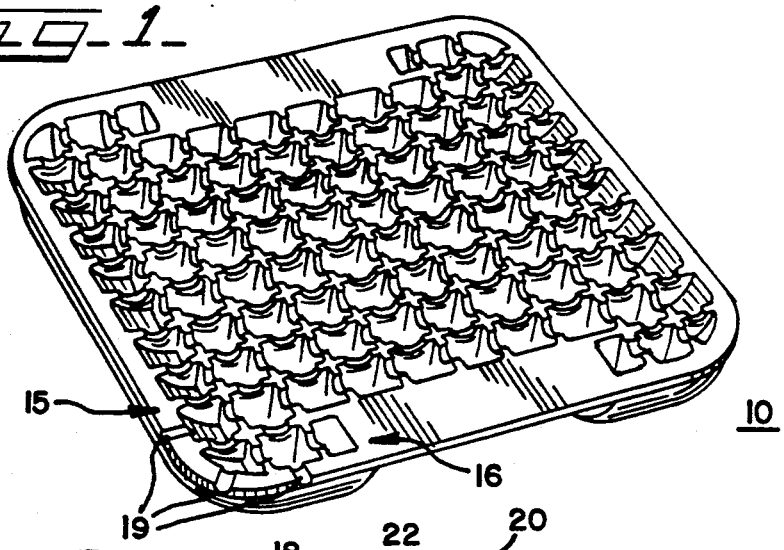
FIG. 1 a general perspective view of a bottom surface of a pavement marker base representing one of the embodiments of the present invention.
Figure 2:
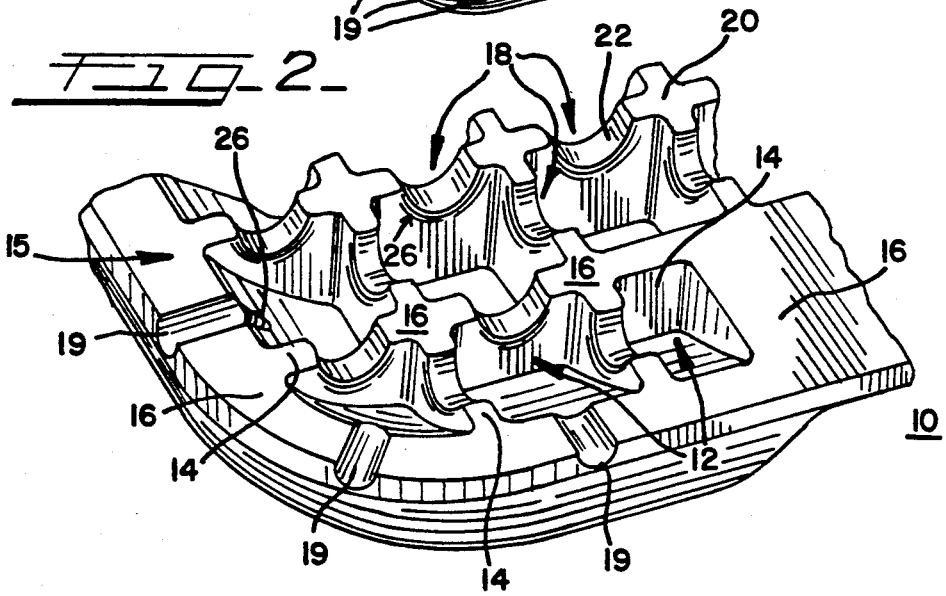
FIG. 2 is an enlarged perspective view of a portion of the marker base in FIG. 1.

The invention, both as to its organization and method of operation, together with further objects and advantages thereof, will be best understood by reference to the following specification taken in connection with the aforementioned drawings. Referring to FIGS. 1 and 2 of the drawings, there is illustrated a roadway marker base member representing one of the embodiments of the present invention. The marker may be that type depicted in U.S. Pat. No. D-267,933, assigned to applicant's assignee. These markers often are used as temporary or construction zone markers, intended to be installed for relatively short intervals where re-routing of traffic may be required. A somewhat similar base pattern, however, also is shown in other marker products, such as illustrated in U.S. Pat. No. 4,208,090, issued June 17, 1980, also assigned to applicant's assignee.

The view depicted in FIGS. 1 and 2 shows the underside configuration of the base member 10. The base member typically is injection molded of any suitable, deformable thermoplastic material. When it is released from the mold, it has a bottom configuration resembling a waffle, with downwardly facing open recesses or chambers 12 divided by common walls 14 and a continuous outer perimeter wall 15. The vertical walls 14 and perimeter wall 15 terminate at the bottom support surfaces 16.

Figure 4:
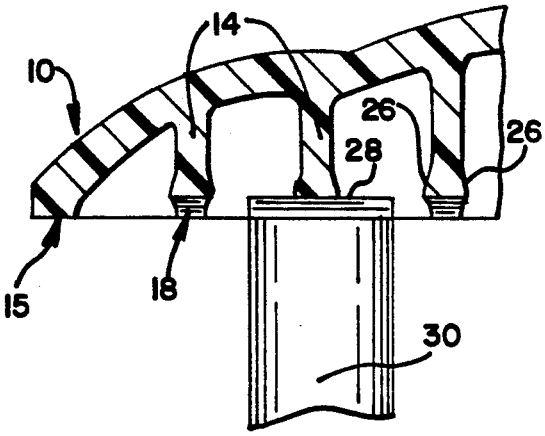
FIG. 4 is a partial sectional side view of the marker base shown in FIG. 1, showing the use of a tool to modify the marker base to embody the present invention.

As will be described in detail below, parallel and intersecting grooves 18 are formed in walls 14, leaving generally cross-shaped wall intersections 20 aligned with the perimeter support surfaces 16. The grooves 18 are bounded by arcuate surfaces 22, which are formed in a post-molding process, as illustrated in FIG. 4, wherein a tool, such as an anvil 30 with a ridge 28, is pressed with sufficient force into each wall 14 to deform the plastic material of the wall upward and outward to form the groove 18. The deformed plastic material is displaced outwardly to form flanges 26 (FIG. 4).

In actual production, it is contemplated that grooves 18 would be formed by an anvil (which may be heated) capable of pressing all of the walls 14 of the marker base 10 in a single stroke to provide the uniform pattern of FIG. 1. Such an anvil (not shown) would have a waffle surface configuration similar to that of the marker, with the intersections of the ridges 28 of the tool displaced to align with the centers of the marker base chambers. In like manner, peripheral grooves 19 preferably are formed in the periphery of support surfaces 16 in perimeter wall 15 (FIG. 2).

This post-molding process of creating the grooves may be accomplished by various methods. The preferred method, as previously described, is the process of "cold-heading" in which a tool 30 having projecting ridge 28 is forced into base member walls 14 and perimeter wall 15 under substantially steady pressure at room temperature. Another method for forming grooves 18 and 19 is "coining." In this method, a tool such as tool 30 is driven into walls 14 of base 10 with a sharp impact. As noted above, yet another method for forming grooves 18 and 19 is accomplished by the use of "thermoforming" or "thermohobbing," in which tool 30 is heated and pressed into wall 14 to the desired depth. In this procedure, tool 30 is typically coated with a non-stick substance to permit ready release of the tool from the marker. The choice of method for creation of grooves 18 and 19 is largely dependent upon the particular thermoplastic material used in the molding of the marker base 10. For example, certain materials that would be deformable at room temperature may be processed by cold-heading.

Figure 5:
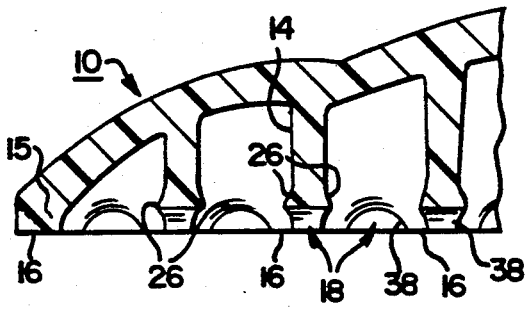
FIG. 5 is a partial sectional side view of the preferred embodiment base member of the present invention.

In FIG. 5, a section of the marker base 10 is shown with the post-molding process completed. In this view, the configuration of the chamber-like recesses can be clearly seen.

Figure 3:
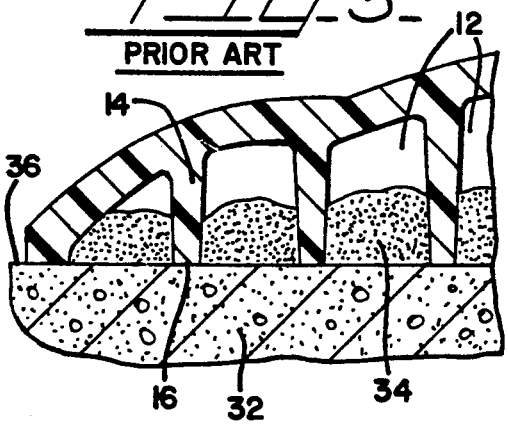
FIG. 3 PRIOR ART
FIG. 3 vertical partial sectional view of a prior art marker base a adhesively mounted to an associated roadway surface.

FIG. 3 illustrates a section of the prior art base marker adhered to an associated roadway 32. As can be seen in this Figure, the marker base has been pressed onto the pavement with adhesive 34 sandwiched between the marker base and the pavement surface 36. If considerable downward pressure is applied to the marker base to seat it firmly on the roadway surface, the adhesive is squeezed into chambers 12, with the lower edges 16 of walls 14 seated on the pavement surface 36, leaving a relatively thin film of adhesive between the support surface 16 formed by horizontal surfaces of walls 14 and roadway surface 36. While FIG. 3 has been exaggerated to show the bottom surfaces of walls 14 in contact with roadway surface 36 without any intervening layer of adhesive 34 in between, it graphically demonstrates the "cookie cutter" phenomenon in which any layer of adhesive between the opposing contact surfaces of marker base 10 and roadway 32 is generally minimal at best. Furthermore, as noted above, walls 14 are tapered inwardly toward the ends 16 terminating at the support surface. Thus, the horizontal terminal portions of the walls provide a small surface area opposing the upwardly-facing roadway surface 36, which results in a minimal adhesive contact area between the two surfaces.

Figure 6:
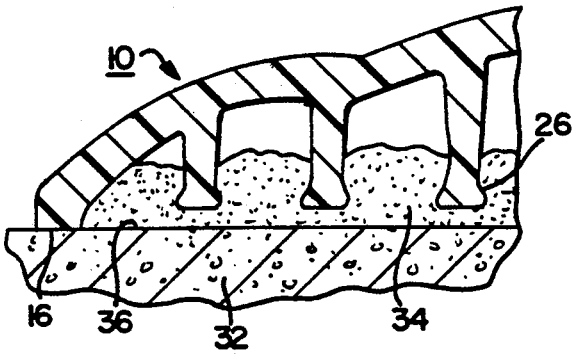
FIG. 6 is a partial sectional side view of the marker embodying the resent invention as adhesively mounted to an associated roadway surface.

Partial sectional views of the marker incorporating the preferred embodiment are illustrated in FIGS. 5 and 6. As deformed by tool 30, the grooves 18 are arcuate in outline and are bounded by arcuate surface 38 and flanges 26, which match and complement the outline of ridge 28 in the anvil 30. As can be seen from FIG. 5, the area of each arcuate surface 38 is larger than the original, undisplaced, downwardly-facing wall surface (16 in FIG. 3), since the arcuate length of surface 38 is longer than the length of the corresponding undeformed horizontal surface 16, and the width of the arcuate surface is greater than the width of that corresponding undeformed horizontal surface by the width of flanges 26.

This lengthening and broadening of the downwardly-facing surface 38 at each wall 14 provides a greater downwardly-facing surface area to accept adhesive and increase contact between the marker and the roadway surface. Additionally, groove 18 provides a predictably sized cavity within chamber wall 14 between arcuate surface 38 and roadway surface 36 to contain, preserve, and assure a quantity of adhesive when the marker is fully seated on the roadway surface 36, thus providing greater adhesion than is possible with the prior art marker and its "cookie cutter" phenomenon. Finally, adhesion between marker base 10 and pavement surface 36 is enhanced by the positive interlock provided between the outwardly displaced flanges 26 and the adhesive 34. There may be other ways to achieve this encapsulation of a predetermined controllable amount of adhesive.

Figure 11:
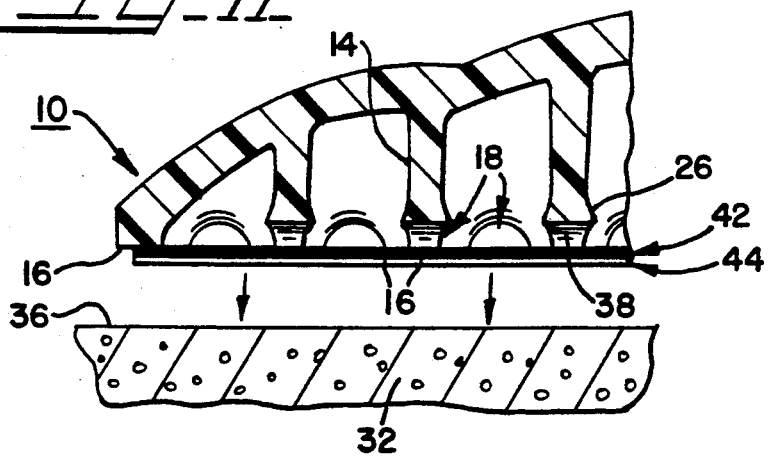
FIG. 11 is a partial sectional side view of the marker base shown in FIG. 6 as adhesively mounted to an associated roadway surface by means of a pre-equipped adhesive pad.

The marker base 10 of the present invention may also be equipped with a preformed adhesive butyl pad 42, as shown in FIG. 11. The butyl pad 42 consists of solid sheet of butyl rubber which is sticky on both sides. A layer of adhesive coating may be added to each side of the butyl rubber pad to enhance this stickiness. The butyl pad 42 is affixed to the bottom support surfaces 16 of chamber walls 14 and outer perimeter wall 15, and the other side of the pad 42 is equipped with a sheet of protective material 44 which is not sticky. When installing marker base 10 on roadway 32, an adhesive material such as bitumin is not initially spread on the pavement surface 36. Instead, the sheet of protective material 44 is peeled off of the butyl pad 42, exposing the sticky surface of the pad, and marker base 10 is placed on the pavement surface 36 and downward pressure exerted on the top of the marker base. The butyl pad 42 will provide a convenient means of adhesion between the bottom support surfaces 16 of the marker base 10 and the roadway pavement surface 36.

Figure 7:
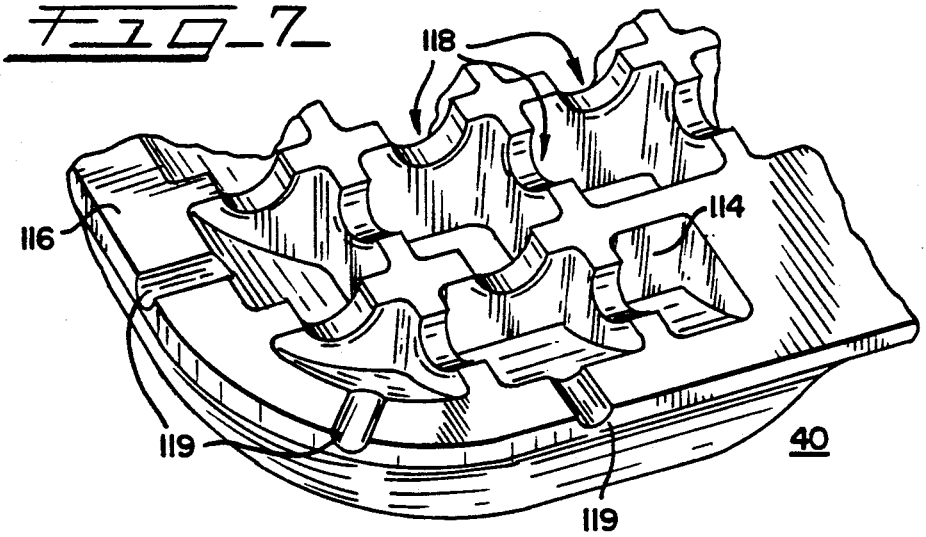
FIG. 7 is a partial perspective view of a marker base incorporating an alternate embodiment of the present invention.

An alternative embodiment of the present invention is shown in FIG. 7. In this version, the marker base is generally indicated by reference character 40. The molded recesses or grooves 118 are shown incorporated in the walls 114, and additional grooves 119 are in the periphery wall bottom support surface 116. Marker base 40 is formed by injection molding only, requiring no cold-heading or other post-molding processing. The grooves 118 in this embodiment provide greater downward facing surface area because of the increased length of the arcuate surface forming the recesses 118 when compared with the prior art face surface of the chamber walls. In addition, this embodiment incorporates the benefit of encapsulating, between the arcuate surface and the roadway surface, a predetermined, controllable amount of adhesive.

Figure 12:
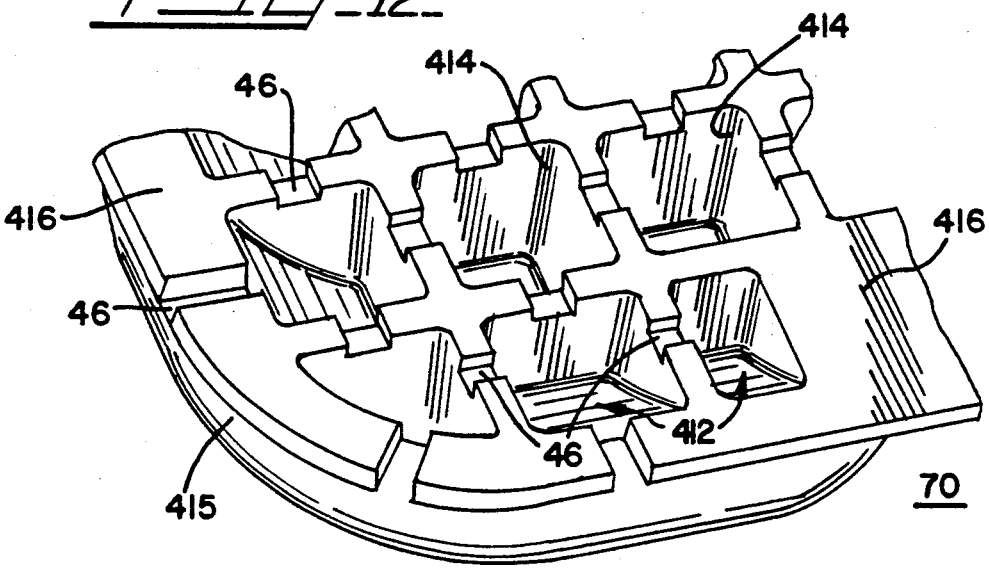
Figure 13:
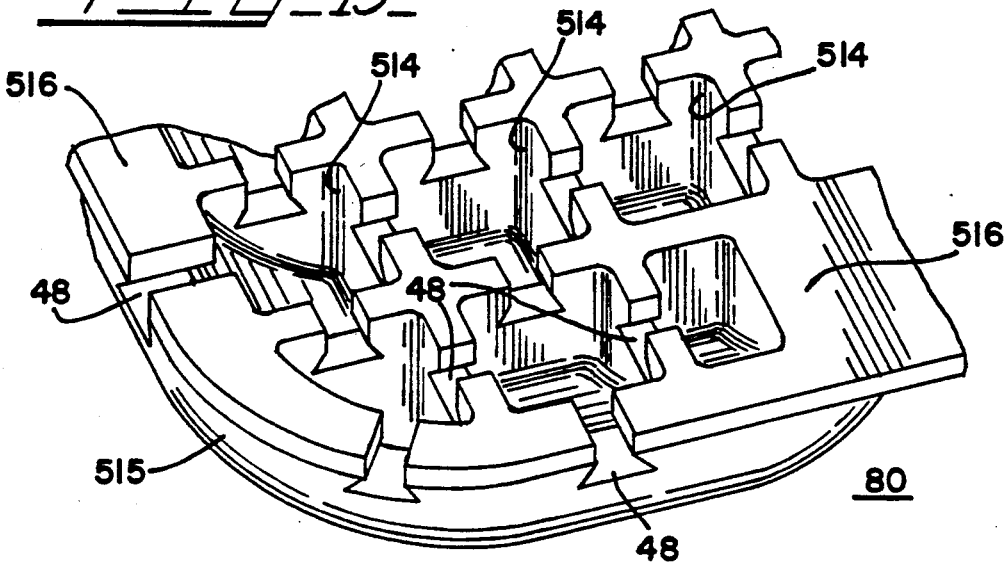
FIG. 13 is a partial perspective view of a marker base incorporating yet another alternate embodiment of the present invention.

While this specification has discussed a roadway marker base 10, having postmolded deformations in the chamber walls characterized by arcuate grooves, a variety of other possible configurations exist. For example, if a uniform layer of adhesive material between the marker base and roadway surface is deemed important, the deformations could adopt the form of rectangular notches 46, as depicted in marker base 70 of FIG. 12. Similarly, the deformations might be characterized by dovetail cuts 48, as shown in marker base 80 of FIG. 13. These and numerous other regularly or irregularly shaped cuts in the chamber walls of the marker base 10 provide broadened surface areas to accept a predetermined, controllable amount of adhesive between the bottom support surfaces of the marker base and the associated roadway pavement surface, as well as flanges to provide interlocking surfaces with the adhesive and facilitate strong bonding. All other elements shown in FIGS. 12 and 13 correspond to the elements already discussed in the arcuate grooved embodiments of the roadway marker base.

Figure 8:
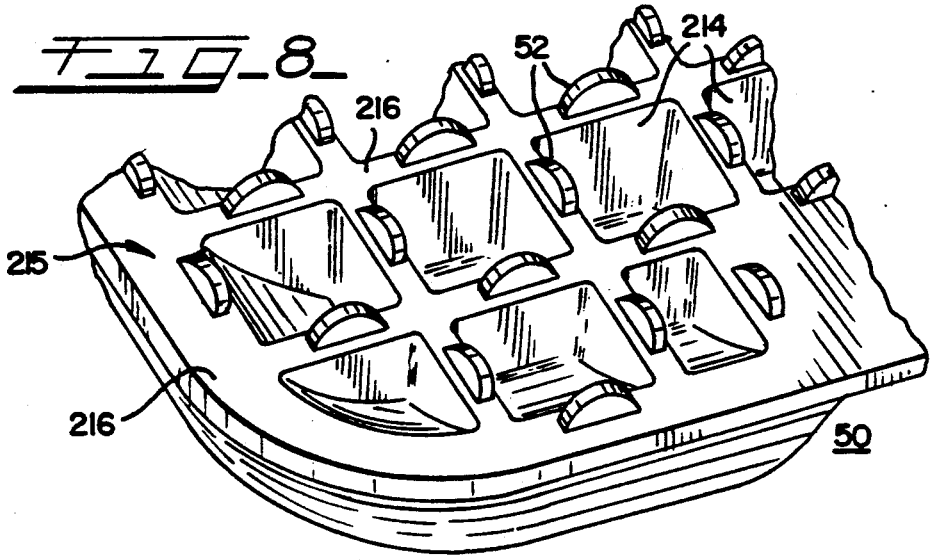
FIG. 8 is a partial perspective view of a marker base incorporating another alternate embodiment of the present invention.

In FIG. 8, another alternative embodiment of the present invention is shown. In this embodiment, the marker base 50 includes integral molded tabs 52 on the bottom surface 216 of each chamber wall 214 and perimeter wall 215. When this configuration is subject to post-molding processing, such as cold-heading, coining, or thermoforming, to create deformations, such as 18 in FIG. 2 (not shown in FIG. 8), the additional plastic material of tabs 52 is displaced outwardly to create a still wider arcuate surface and flanges 26 (not shown) which project farther from the walls 214 to effect an even stronger interlock between the outwardly projecting lips and the adhesive.

Figure 9:
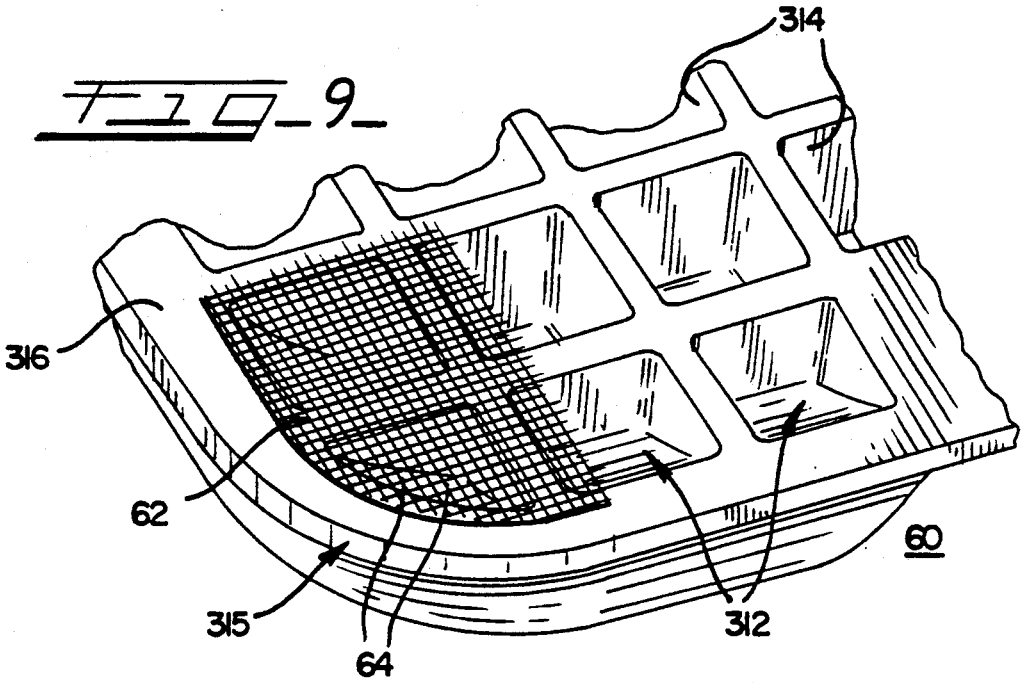
FIG. 9 is a partial perspective view of a marker base incorporating still another alternate embodiment of the present invention.
Figure 10:
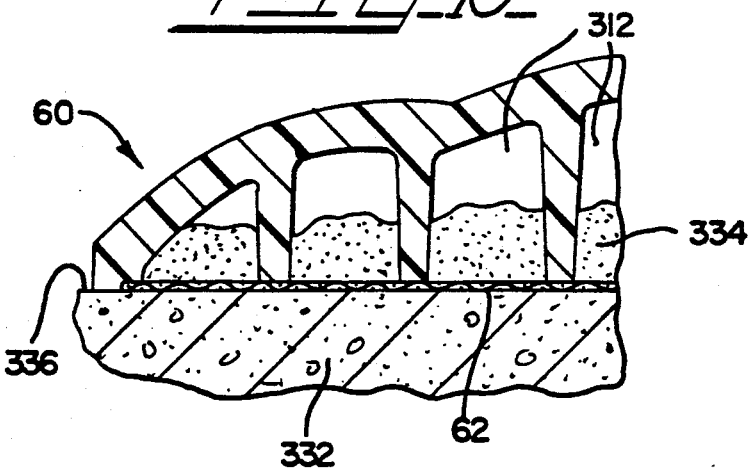
FIG. 10 is a partial sectional side view of the marker base shown in FIG. 9.

In FIGS. 9 and 10, yet another embodiment of the present invention is shown. In this embodiment, the marker base 60 is formed as in the prior art, and does not contain any deformations or molded tabs. Instead, after the base is injection molded with the waffle-like bottom configuration having downwardly-facing open chambers 312 divided by common walls 314 terminating at the bottom support surfaces 316, a piece of wire screen or mesh 62 is provided to cover at least some of the surface area bound by perimeter wall 315. The mesh 62 is laid across the bottom of the marker within the plane of the bottom support surface. This post-molding process is then completed by imbedding the mesh 62 into the bottom surfaces 316 of walls 314 and perimeter support wall 315 so that the mesh is securely fastened to the bottom of the marker. A variety of imbedding methods may be used, such as ultra-sonic forming of thermo-forming.

The marker, as shown in FIG. 10, is used in the same manner as described for the previous embodiments. A layer of bitumen 334 is spread on the pavement surface 336 of roadway 332. When the marker 60 is placed on top of the roadway and downward pressure is exerted, adhesive 334 seeps upwards through openings 64 in wire mesh 62 into recess chambers 312. In this way, there is even greater surface area in the wire mesh for the adhesive to adhere to, providing an even stronger interlock between the two, and thereby securely attaching marker 60 to roadway surface 336.

While the foregoing specification has described and explained particular embodiments of the invention incorporating regular, waffle-like arrays of chambers defined in the underside of the marker base, it is contemplated that various configurations of chamber wall patterns may be utilized. Such patterns also may include chambers that are either square, rectangular, circular, triangular, or various irregular varieties as well as outwardly facing, open-sided chambers along the periphery of the base. Therefore, the invention is contemplated to cover by the present application any and all such modifications which fall within the true spirit and scope of the basic underlying principles disclosed and claimed herein.

What is claimed is:

1. A pavement marker base having a generally planar bottom support surface to be secured to an underlying roadway surface, said base comprising:

a plurality of recesses defined in and extending upwardly from said bottom support surface, with each recess comprising a chamber surrounding by support walls transverse to said bottom support surface and having a bottom face, with at least a portion of each of said bottom faces of said support walls lying within and defining the plane of said bottom support surface; and integrally formed anchoring means extending upwardly from at least some of the bottom faces of said support walls, terminating laterally beyond the chamber sides defining said support walls, and opening to the chambers, said anchoring means being arranged and configured to cooperate with an associated adhesive so that said anchoring means maintain an adequate thickness of the adhesive between the bottom support surface of the marker base and the associated roadway surface, and facilitate securement and adhesion of the pavement marker base to the associated roadway surface.

2. The pavement marker base as recited in claim 1, wherein said anchoring means comprises a plurality of deformations provided in the bottom faces of at least some of said support walls, said deformations extending upwardly from the bottom support surface of the marker base.

3. The pavement marker base as recited in claim 2, wherein at least some of said deformations are bounded by a generally arcuate surface facing towards said bottom support surface, and greater in width than the width of said support walls, thereby facilitating an interlock between the marker base and the adhesive securing the marker base to theunderlying associated roadway.

4. The pavement marker base as recited in claim 2, wherein at least some of said deformations are bounded by a generally rectangularly notched surface facing towards said bottom support surface, and greater in width than the width of said support walls, thereby facilitating an interlock between the marker base and the adhesive securing the marker base to the underlying associated roadway.

5. The pavement marker base as recited in claim 2, wherein at least some of said deformations are bounded by a generally dovetailed surface facing towards said bottom support surface, and greater in width than the width of said support walls, thereby facilitating an interlock between the marker base and the adhesive securing the marker base to the underlying associated roadway.

6. The pavement marker base as recited in claim 1, further comprising a piece of wire mesh disposed on the bottom face of at least a portion of said support walls to further facilitate interlock between the marker base and the adhesive securing the marker base to the underlying associated roadway.

7. The pavement marker base as recited in claim 1, wherein the associated adhesive is bitumin.

8. The pavement marker base as recited in claim 7, wherein the bitumin is contained in a preformed pad.

9. The pavement marker base as recited in claim 1, wherein the associated adhesive is cement.

10. The pavement marker base as recited in claim 1, wherein the associated adhesive is epoxy.

* * * * *